United States Patent [19]

Hayes et al.

[11] 4,453,501

[45] Jun. 12, 1984

[54] TRANSDUCER FOR DETERMINING IF STEAM GENERATOR TUBES ARE LOCKED IN AT SUPPORT PLATE

[75] Inventors: James K. Hayes, Chattanooga, Tenn.; Lawrence R. Hayes, Ringgold, Ga.

[73] Assignee: Combustion Engineering, Inc., Windsor, Conn.

[21] Appl. No.: 447,048

[22] Filed: Dec. 6, 1982

[51] Int. Cl.[3] ..... F22B 37/24

[52] U.S. Cl. ..... 122/510; 165/11 R; 376/245; 72/432

[58] Field of Search ..... 374/6, 55; 72/432 V; 122/510; 165/11 R; 376/245

[56] References Cited

U.S. PATENT DOCUMENTS 3,880,123 4/1975 Freiday ..... 122/510

*Primary Examiner*—Albert J. Makay
*Assistant Examiner*—David E. Helmbold
*Attorney, Agent, or Firm*—Robert L. Olson

[57] ABSTRACT

A nuclear steam generator including a vessel, means to introduce vaporizable fluid into the bottom portion of the vessel, an outlet near the top through which vapor is discharged, a horizontal tube sheet extending across the vessel, a plurality of U-shaped tubes, having each end secured to and extending through the tube sheet, means for introducing heating fluid to one end of each of the U-shaped tubes, means for removing heating fluid from the other end of each of the U-shaped tubes, tube support means positioned within the vessel for preventing tube vibration, the tube support means including horizontally positioned means closely surrounding, but slightly spaced from each tube, means through which access can be had to the vessel interior beneath the tube sheet when the steam generator is not in operation, and testing means for determining whether or not a tube is locked into a tube support means including a longitudinal member, with a first end located inside the tube to be tested, and a second end located outside of the tube, means for securing the first end of the member to the inside of the tube, means for heating a length of the longitudinal member, and an equal length of the tube, to an elevated temperature, and means for indicating movement of the second end of the longitudinal member away from the tube end, which would indicate that the tube is locked into the support means.

3 Claims, 2 Drawing Figures

TRANSDUCER FOR DETERMINING IF STEAM GENERATOR TUBES ARE LOCKED IN AT SUPPORT PLATE

BACKGROUND OF THE INVENTION

In shell and tube heat exchangers, such as nuclear steam generators, tube supports are used to minimize tube vibration induced by the fluid flowing on the shell side of the exchanger. These tube supports may be drilled plates, machined plates with various clearances around the tube, or lattice supports built from metal strips or bars. In any event, there exists areas of close clearance between the tube and support. One of the most widespread and serious problems observed in nuclear steam generators is "denting", a term used to describe the tube distortion which results when a tube support corrodes to the point where it squeezes the steam generating tubing. As this phenomenon begins, the tube tends to "lock in" at the support plate. The tubes may become locked in before any measurable denting has been detected. If a tube locks in at a support plate, it may result in stresses within the tube which could cause considerable damage. It is therefore desirable to have a means for determining if selected nuclear steam generator tubes are in a locked in condition.

SUMMARY OF THE INVENTION

In accordance with the invention, means are provided for determining whether or not a nuclear steam generator tube is locked into a support plate. The means for accomplishing this is a rod that is inserted up into a tube, with means on the end of the rod for securing it to the inner surface of the tube. A heat element surrounds a longitudinal portion of the rod, so that both the rod and the tube adjacent to the heating element are heated. A gauge is located outside of the tube for indicating relative movement of the tube and rod, which indicates whether or not the tube is locked to the support plate.

DESCRIPTION OF THE PREFERRED EMBODIMENT

Figure 1:
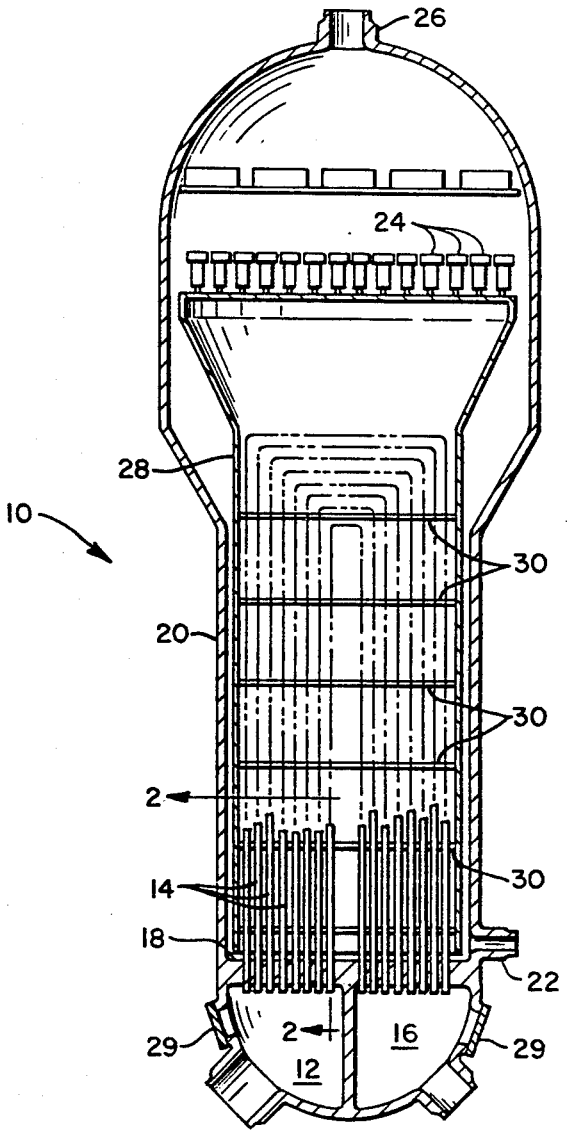
FIG. 1 is an elevational section view of a nuclear steam generator.

Looking now to FIG. 1 of the drawing, numeral 10 denotes a nuclear steam generator in which heating fluid, being water at high temperature, flows from inlet manifold 12, through tubes 14, and out of the outlet manifold 16. All of the tubes 14 are secured at their bottom ends to a tube sheet 18. The inlet fluid, generally being water below saturation temperature, enters the shell 20 through the inlet 22, mixes with the recirculated fluid flowing downwardly through the annular space between the shell 20 and shroud 28, thence upwardly through the tube bundle 14, absorbing heat in doing so, forming a mixture of steam and water. The separators 24 at the top of the vessel separate the water from the steam. The steam leaves the unit through outlet 26, and the water flows down the annular space for mixing with the water entering the shell 20 through inlet 22. Covers 29 close manway openings in the shell which permit personnel to enter the manifolds during maintenance shutdowns.

Positioned at a number of vertical locations throughout the vessel are a series of tube supports 30. These supports, which are for the purpose of preventing tube vibration induced by the fluid flowing on the shell side of the heat exchanger may be drilled plates having oversized holes therein, so that they not only keep the tubes in place and prevent vibration, but also permit flow therethrough. The tube supports could also be in other forms, for example a grid made up of strips or bars of metal, such as shown in U.S. Pat. No. 3,941,188.

Regardless of the type of tube support used, there exist areas of tight clearance between the tubes and support. In many instances, the shell side fluid which flows through the crevices is partially or wholly evaporated by the heat transferred from the tube side to the shell side fluid. The crevice formed by a tube and its support is especially vulnerable to high solids deposition due to partial or total evaporation of the water as it flows through the crevice. The solids accumulation in the crevice can lead to "locking in" of the tubes to the support, and eventually to the denting or crimping of the tubes.

Figure 2:
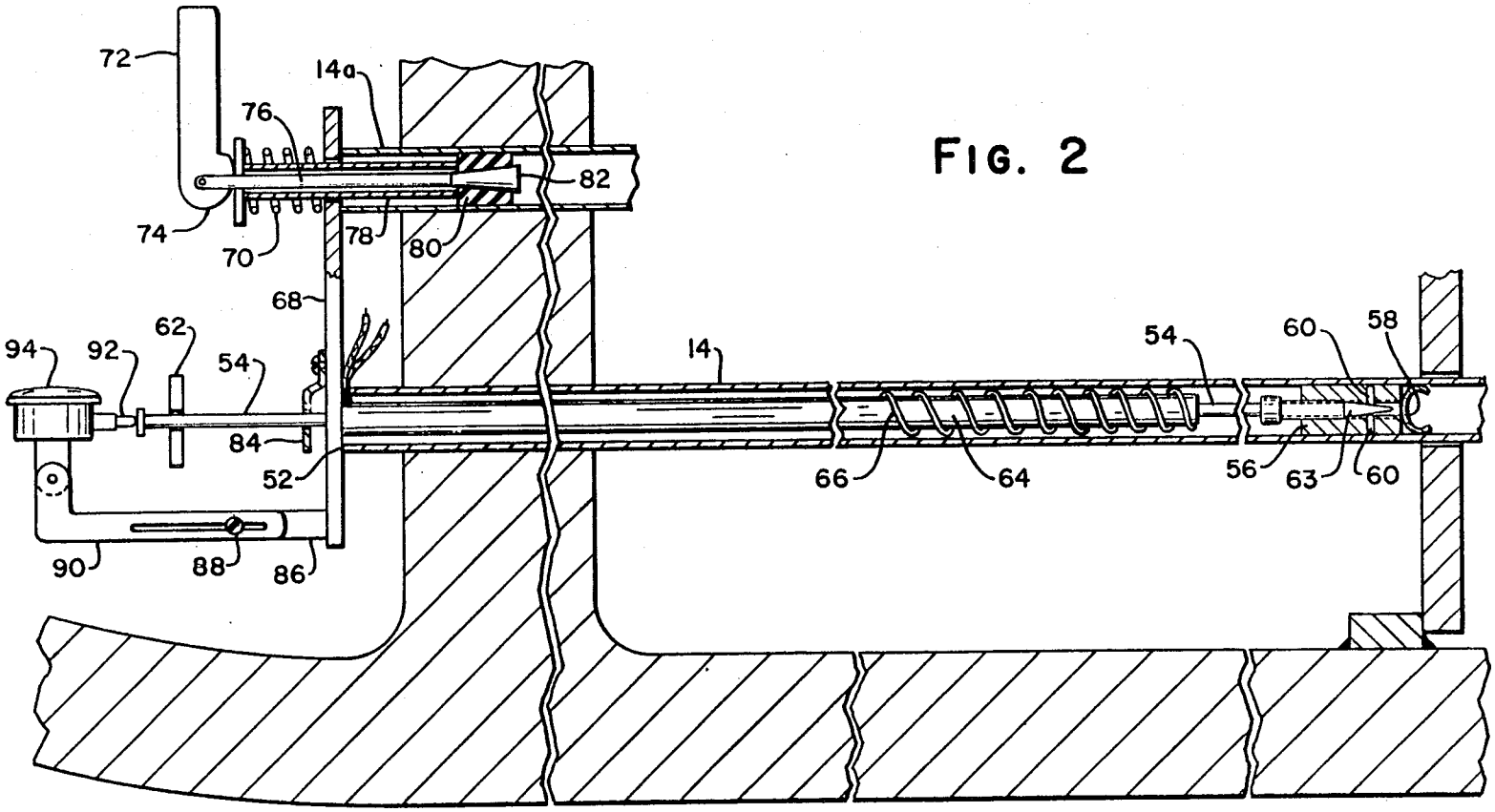
FIG. 2 is a partial enlarged view taken on line 2—2 of FIG. 1, showing the incorporation of the measuring device of the invention.

FIG. 2 shows apparatus which can be used during a maintenance shutdown to determine whether or not selective tubes are locked into the support. During a maintenance shutdown, personnel can enter the manifolds 12 and 16 (FIG. 1) by removing manway covers 29, so that the testing of selective tubes can be accomplished. Looking now to FIG. 2, the testing apparatus can be inserted up into a tube 14 through its open end 52. The top of the rod 54 has a threaded portion which is threaded into a cylindrical member 56. A spring clip 58 is attached to the member 56. Three pins 60 are located in radial openings, spaced 120° apart. After the rod has been inserted into the tube 14, it can be rotated by means of wing 62 at its lower end, causing the upper threaded end to be threaded further into cylindrical member 56. The spring clip keeps the cylindrical member 56 from rotating or moving during this threading procedure. As rod 54 is threaded further into member 56, the tapered end 63 engages the pins 60, moving them radially outwardly, making slight indentations in the inner surface of tube 14, securing the upper part of the device to the tube.

Surrounding the lower portion of the rod 54 throughout a major portion of its length is a tube 64. Surrounding the tube 64 is a nichrome heating coil or element 66. The lower end of the apparatus is secured in place by attaching it to an adjacent steam generator tube. A bar 68 is pressed against the end of adjacent tube **14*a* by a loading spring 70. Lever 72 has a cam lock 74 at the end thereof for moving rod 76 to the left with respect to tubular member 78, and locking it in this position. Attached to the other end of member 78 is member 80, which is forced into tight engagement with the inner walls of tube 14*a* by the frustoconical head 82, when rod 76 is moved to the left. Attached to the other end of bar 68 is the lower end of the tube 64. Also attached to bar 68 is a guide member 84, through the rod 54 passes. An adjustable support member 86 is also supported by bar 68. By loosening screw 88, the position of link 90 can be adjusted so that the end of rod 54 just contacts the end of finger 92 on the gauge 94**.

Once the apparatus has been secured in place, the heating element 66 can be energized, and the test run. The rod 54 should be constructed of the same material as that of the steam generator tubes 14, so that it has the same coefficient of expansion. The nichrome heating element 66 should be capable of heating both the adjacent steam generator tube 14 and the rod 54 to approximately 300–400 F., for the length of the heater. Since the steam generator tube 14 is secured at its bottom end only, to the tube sheet 18 (see FIG. 1), it is free to expand upwardly if it is not "locked in" at one of the support members 30. Since rod 54 is secured only at its upper end to the inner surface of tube 14, it is free to expand at its lower end. Since they are both made of the same material (most likely inconel), they will each grow an equal amount (in opposite directions) when heated equally, and the gauge 94 will register 0. If the tube 14 is locked in at the support member, it will not be able to grow with thermal expansion, and the gauge will register the growth of the rod 54 due to its thermal expansion. Thus the operator will know that the tube is locked into the support member if this occurs. As many selective tubes can be tested as deemed necessary during a maintenance shutdown. After the testing has been accomplished, the apparatus can be disassembled and removed through the manways so that the steam generator can be put back into operation.

From the above, it can be seen that the apparatus can be used for accurately and reasonably indicating whether or not nuclear steam generator tubes are locked into the support member. The test equipment can be quickly assembled and disassembled. Since the manifolds of steam generators are radioactive, personnel can only stay in for a relatively short time. Thus, is of importance. The rod 54 could be made of metal other than that which the steam generator tubes are made of However, then the thermal cofficient of expansion would be different, and an operator would have to make calculations. Making the rod of inconel, which is the tube material also, is preferable.

We claim:

1. In combination, a nuclear steam generator including a vessel, means to introduce vaporizable fluid into the bottom portion of the vessel, an outlet near the top through which vapor is discharged, a horizontal tube sheet extending across the vessel, a plurality of U-shaped tubes, having each end secured to and extending through the tube sheet, means for introducing heating fluid to one end of each of the U-shaped tubes, means for removing heating fluid from the other end of each of the U-shaped tubes, tube support means positioned within the vessel for preventing tube vibration, the tube support means including horizontally positioned means closely surrounding, but slightly spaced from each tube, means through which access can be had to the vessel interior beneath the tube sheet when the steam generator is not in operation, and testing means for determining whether or not a tube is locked into a tube support means including a longitudinal member, with a first end located inside the tube to be tested, and a second end located outside of the tube, means for securing the first end of the member to the inside of the tube, means for heating as length of the longitudinal member, and an equal length of the tube, to an elevated temperature, and means for indicating movement of the second end of the longitudinal member away from the tube end, which would indicate that the tube is locked into the support means.

2. The combination set forth in claim 1, wherein the tube and longitudinal member are both made of the same metal.

3. The combination set forth in claim 2, wherein the testing means is supported by a member secured to the inner surface of a tube adjacent to the tube being tested.

* * * * *